US011172737B2

(12) United States Patent
Hosoe

(10) Patent No.: US 11,172,737 B2
(45) Date of Patent: Nov. 16, 2021

(54) SLIDER FOR SLIDE FASTENER

(71) Applicant: YKK CORPORATION, Tokyo (JP)

(72) Inventor: Kazuki Hosoe, Kurobe (JP)

(73) Assignee: YKK CORPORATION, Tokyo (JP)

( * ) Notice: Subject to any disclaimer, the term of this patent is extended or adjusted under 35 U.S.C. 154(b) by 0 days.

(21) Appl. No.: 16/967,896

(22) PCT Filed: Feb. 16, 2018

(86) PCT No.: PCT/JP2018/005525
§ 371 (c)(1),
(2) Date: Aug. 6, 2020

(87) PCT Pub. No.: WO2019/159331
PCT Pub. Date: Aug. 22, 2019

(65) Prior Publication Data

US 2021/0022456 A1 Jan. 28, 2021

(51) Int. Cl.
*A44B 19/26* (2006.01)

(52) U.S. Cl.
CPC ..... *A44B 19/26* (2013.01)

(58) Field of Classification Search
CPC ..... Y10T 24/2586; A44B 19/26
See application file for complete search history.

(56) References Cited

U.S. PATENT DOCUMENTS

D380,987 S * 7/1997 Izumi ..... D11/221
D393,431 S * 4/1998 Kawamura ..... D11/221
D446,165 S * 8/2001 Yoneoka ..... D11/221
D629,332 S * 12/2010 Miyazaki ..... D11/221
D629,333 S * 12/2010 Miyazaki ..... D11/221
(Continued)

FOREIGN PATENT DOCUMENTS

CN 203087779 U 7/2013
TW M437637 U 9/2012
(Continued)

OTHER PUBLICATIONS

International Preliminary Report on Patentability for related PCT App No. PCT/JP2018/005525 dated Aug. 27, 2020, 6 pgs.
(Continued)

*Primary Examiner* — Robert Sandy
*Assistant Examiner* — Louis A Mercado
(74) *Attorney, Agent, or Firm* — Procopio, Cory, Hargreaves & Savitch LLP

(57) ABSTRACT

A slider having a tab connecting part provided on a surface of the upper blade of the slider body. The tab connecting part has a cantilevered tab connecting post, with one end portion fixed to the surface of the upper blade at one end and the other end portion is separated from the surface at the other end in the longitudinal direction; and a closing member attached between the other end portion of the tab connecting post and the surface of the upper blade. The slider body includes a fixing portion provided on the surface of the upper blade. The closing member includes an outside portion defining a surface facing opposite to the one end portion, where the closing member is attached to the surface of the upper blade, and an engaging portion, provided on the one end portion-side of the outside portion and engageable with the fixing portion.

10 Claims, 24 Drawing Sheets

(56) References Cited

U.S. PATENT DOCUMENTS

| | | | | |
|---|---|---|---|---|
| 7,870,650 | B2 * | 1/2011 | Keyaki | A44B 19/26 24/424 |
| 8,381,369 | B2 * | 2/2013 | Wang | A44B 19/26 24/415 |
| 8,650,724 | B2 * | 2/2014 | King | A45C 13/103 24/415 |
| 8,661,629 | B2 * | 3/2014 | Wang | A44B 19/26 24/415 |
| 8,793,847 | B2 * | 8/2014 | Chung | A44B 19/382 24/382 |
| 9,220,323 | B2 * | 12/2015 | Hamada | F16B 45/04 |
| 9,427,051 | B2 * | 8/2016 | Hsu | A44B 19/26 |
| 9,888,747 | B2 * | 2/2018 | Smith | A44B 19/30 |
| 2012/0291235 | A1 | 11/2012 | Hsu et al. | |
| 2015/0335107 | A1 | 11/2015 | Hamada et al. | |
| 2017/0295891 | A1 | 10/2017 | Honda | |

FOREIGN PATENT DOCUMENTS

| | | | |
|---|---|---|---|
| WO | 2011086703 | A1 | 7/2011 |
| WO | 2014073111 | A1 | 5/2014 |
| WO | 2016042676 | A1 | 3/2016 |
| WO | 2016051538 | A1 | 4/2016 |

OTHER PUBLICATIONS

International Search Report and Written Opinion for PCT App No. PCT/JP2018/005525 dated May 15, 2018, 5 pgs. (partial translation).

* cited by examiner

SLIDER FOR SLIDE FASTENER

CROSS-REFERENCE TO RELATED APPLICATIONS

This application is a U.S. National Stage entry of PCT Application No: PCT/JP2018/005525 filed Feb. 16, 2018, the contents of which are incorporated herein by reference.

TECHNICAL FIELD

The present invention relates to a slider for a slide fastener, particularly to a slider, in which a portion of a pull tab connecting part for connecting a pull tab is configured as a detachable component.

BACKGROUND ART

A slider for a slide fastener, in which a portion of a pull tab connecting part, provided on a slider body, for connecting a pull tab, is configured as a detachable or exchangeable component is disclosed in, for example, WO 2016/042676 (Patent Document 1), TW M437637 U1 (Patent Document 2), and CN 203087779 U (Patent Document 3). In these sliders, a closing member as a detachable or replaceable component is attached to between a free end (end opposite to the proximal end) of a cantilevered pull tab connecting post provided on the slider body and an upper surface of the slider body. Thereby, it is possible to retrofit a pull tab that a user prefers, or to add a new pull tab by detaching or exchanging only the closing member without exchanging the entire slider when the pull tab is damaged, for example.

However, in the above-mentioned sliders, there is a problem that the structure for fixing the closing member to the slider body or the pull tab connecting post is exposed to the outside and is easily seen from the outside, giving an intricate impression. In addition, in combination with the fact that the fixing structure is exposed, there is also a problem that it is difficult to make the entire appearance of the pull connecting portion including the closing member a unity. Further, in the above-mentioned sliders, the closing member is fixed not only to the slider body but also to the free end of the pull tab connecting post, and therefore it is necessary to provide both of the free end portion of the pull tab connecting post and a portion of the closing member corresponding to the free end portion with structure connectable to each other, increasing the manufacturing cost accordingly. For example, in the slider of Patent Document 1, there is provided a concave portion on the guide post side of the slider body and over the upper and lower blades, and the closing member is fitted in this concave portion, and the free end portion of the pull tab connecting post is connected with an upper portion of the closing member. Therefore, a portion of the closing member can be seen from not only the guide post side between the upper and lower blades but also from the lower surface of the lower blade, and the free end portion of the pull tab connecting post and the upper portion of the closing member have complicated shapes. In the slider of Patent Document 2, there is provided a mounting groove, on the upper blade of the slider body, over the entire width in the width direction and on the side opposite to the guide post in the longitudinal direction, and a base of the closing member is fitted in the mounting groove in the width direction, and an upper portion of the closing member is connected with the free end portion of the pull tab connecting part. Therefore, the mounting groove appears on the upper surface and the left and right surfaces of the upper blade, and the connecting structure between the free end portion of the pull tab connecting part and the closing member is exposed. Further, in the slider of Patent Document 3, there are provided elastic claws respectively on the free end portion of the pull tab connecting post and on the upper surface of the slider body facing the free end portion, and the closing member in a rectangular, annular shaped is attached to the upper and lower elastic claws. The upper and lower elastic claws can be seen from the outside in the longitudinal direction of the slider body even after the closing member is attached.

CITATION LIST

Patent Literatures

[Patent Document 1] WO 2016/042676
[Patent Document 2] TW M437637 U1
[Patent Document 3] CN 203087779 U

SUMMARY OF THE INVENTION

Technical Problem

Therefore, an object of the present invention is to provide a slider for a slide fastener, in which the structure for fixing a closing member to a slider body is not exposed to the outside, and the overall appearance of a pull tab connecting part including the closing member can be integrated into a unity. Further, another object of the present invention is to provide a slider for a slide fastener having a structure in which a closing member is not fixed to a free end portion of a pull tab connecting post of a slider body.

Solution to Problem

To solve the above problems, according to the present invention, there is provided a slider for a slide fastener, comprising: a slider body including an upper blade, a lower blade, and a guide post connecting between one end sides, in a longitudinal direction, of the upper and lower blades, and a pull tab connecting part provided on an upper surface of the upper blade of the slider body for connecting a pull tab; wherein the pull tab connecting part comprises a cantilevered pull tab connecting post, in which one end portion is fixed to the upper surface of the upper blade at one end side or the other end side in the longitudinal direction and the other end portion is separated from the upper surface at the other end side or the one end side in the longitudinal direction; and a closing member attached to between the other end portion of the pull tab connecting post and the upper surface of the upper blade; wherein the slider body includes a fixing portion provided on the upper surface of the upper blade for fixing the closing member; wherein, the closing member includes an outside portion defining an outside surface facing the side opposite to the one end portion of the pull tab connecting post in the longitudinal direction, in a state where the closing member is attached to the upper surface of the upper blade, and an engaging portion, which is provided on the one end portion-side of the outside portion and is engageable with the fixing portion.

According to the slider according to the present invention, the pull tab connecting part on the slide body is composed of the cantilevered pull tab connecting post, in which one end portion (proximal portion) is fixed to the upper surface of the upper blade, and the closing member attached to between the other end portion of the pull tab connecting post and the upper surface of the upper blade. The closing member can be detachable or replaceable. In the present invention, the one end portion (proximal portion) of the pull tab connecting post is located on the guide post-side or the opposite side in the longitudinal direction of the slider body. In this specification, the longitudinal direction of the slider body is the same as the longitudinal direction of a fastener chain on which the slider body can move in one direction or the other direction. Further, in the present invention, the closing member comprises the outside portion defining the outside surface facing the side (outside in the longitudinal direction) opposite to the one end portion of the pull tab connecting post in the longitudinal direction, in the state of being attached to the upper surface of the upper blade, and the engaging portion that is provided on the one end portion (of the pull tab connecting post)-side (inside in the longitudinal direction) of the outside portion and that is engageable with the fixing portion. The closing member can be fixed at a predetermined position on the upper surface of the upper blade of the slider body by engaging the engaging portion with the fixing portion provided on the upper surface of the upper blade. In the present invention, the engaging portion of the closing member is provided on the one end portion (of the pull tab connecting post)-side of the outside portion, or on inside back, in the longitudinal direction, of the outside portion. Also, the fixing portion is provided on the inside back side, in the longitudinal direction, of the outside portion of the closing member in the state of being attached to the upper surface of the upper blade, in order to engage with the engaging portion of the closing member. Therefore, it is possible to arrange the engaging portion of the closing member and the fixing portion so as to be covered by the outside portion of the closing member. Further, it is also possible to arrange flexible portions having lock claws of the engaging portion or the fixing portion, locking portions of the fixing portion or the engaging portion, and positioners in either or both of the fixing portion or/and the engaging portion, as described later, which are substantially the structure (engaging and positioning structures or inside structure for fixing) for fixing the closing member to the slider body, so as to be covered by the outside portion of the closing member and the engaging portion and to be prevented from being exposed to the outside. Thereby, the above engaging and positioning structures become difficult to be seen from the outside. In this way, by covering the locking and positioning structures between the engaging portion of the closing member and the fixing portion with the outside portion and the engaging portion of the closing member, it is possible to give the overall appearance of the pull tab connecting part including the closing member a unity by matching the appearance of the closing member to the appearance of the pull tab connecting post.

In the present invention, the closing member may be molded from a thermoplastic resin such as polyacetal, polyamide, polypropylene, polybutylene terephthalate, but not limited thereto. In addition, in the present invention, the pull tab connecting post and the fixing portion may be, for example, metal parts cast integrally with the upper blade of the slider body, or may be metal or resin parts fixed to the upper blade.

According to one embodiment of the present invention, at least a portion of the fixing portion is arranged, in the longitudinal direction, between an edge on the one end portion-side in the other end portion of the pull tab connecting post and an edge on the other end portion-side in the one end portion of the pull tab connecting post. In this case, the fixing portion extends beyond the edge (see the reference numeral 31*ba* in FIGS. 5 and 15) of the one end portion-side in the other end portion of the pull tab connecting post toward the one end portion (proximal portion) of the pull tab connecting post. Further, correspondingly to the fixing portion, the engaging portion of the closing member in the state of being attached can be designed to extends beyond the edge of the one end portion-side of the other end portion of the pull tab connecting post toward the one end portion (proximal portion) of the pull tab connecting post. In this way, by extending the fixing portion and the engaging portion of the closing member, which are engaged with each other, in the longitudinal direction, when a user pulls a pull tab connected to the pull tab connecting part, it becomes easy to secure the strength against that pull. Further, it becomes easy to cover the locking and positioning structures between the engaging portion and the fixing portion as mentioned above.

According to one embodiment of the present invention, one of the engaging portion and the fixing portion includes one or more flexible portions having one or more lock claws, and the other of the engaging portion and the fixing portion includes one or more locking portions which are configured to receive and lock the lock claws. In this embodiment, when the closing member is attached, the lock claws of the flexible portions are locked by the locking portions of the fixing portion or the engaging portion of the closing member while the flexible portions of the engaging portion or the fixing portion are flexed or bent.

According to one embodiment of the present invention, at least one of the engaging portion and the fixing portion includes a positioner for restraining the closing member in the position where the lock claws are locked by the locking portions. The positioner may be, for example, a convex portion and a concave portion that can fit each other, but not limited thereto and that can restrain the closing member in the position where the lock claws in one of the engaging portion of the closing member and the fixing portion is locked by the locking portions in the other. It can be said that the locking structure between the lock claws and the locking portions and the positioning structure by the positioner are substantially the structure for fixing the closing member to the slider body. In the present invention, it is possible to give a neat appearance without exposing such a fixing structure to the outside.

According to one embodiment of the present invention, the engaging portion comprises a pair of legs in a width direction of the slider body, and the lock claws and the locking portion are arranged between the pair of the legs. In this case, the locking structure of the lock claws and the locking portion is arranged on the inside back side, in the longitudinal direction, of the outside portion of the closing member and further between the pair of the legs in the width direction. Therefore, it is possible to make the locking structure difficult to be seen from the outside by covering it with the outside portion of the closing member and the pair of the legs of the engaging portion.

According to one embodiment of the present invention, the closing member in a state of being attached to the upper surface of the upper blade is non-fixedly aligned with the other end portion of the pull tab connecting post. In this embodiment, in the state where the closing member is attached, the closing member and the other end portion (free end portion) of the pull tab connecting post are not connected to each other but simply aligned. Therefore, it is not necessary to complicate the configuration each of the other end portion of the pull tab connecting post and an upper portion of the closing member that corresponds to the other end portion. A convex portion of the pull tab connecting post and a concave portion of the closing member, which are described in an embodiment of the present invention, are not for mutual connection but for the purpose of mere alignment in non-fixed manner.

According to one embodiment of the present invention, the fixing portion is located higher than the upper surface of the upper blade. In this embodiment, the fixing portion includes portions that are raised from the upper surface of the upper blade, and may include space portions that are not raised from the upper surface of the upper blade.

According to one embodiment of the present invention, the flexible portions are a leaf spring provided in the engaging portion of the closing member, the leaf spring being flexible in the vertical direction. In this case, the lock claws of the flexible portions are locked by the locking portion of the fixing portion while the leaf spring of the engaging portion of the closing member is bent in the vertical direction.

Advantageous Effects of Invention

In the present invention, both of the engaging portion of the closing member and the fixing portion are provided on the side (inside in the longitudinal direction) of the one end portion of the pull tab connecting post with respect to the outside portion of the closing member, and therefore it is possible to arrange the engaging portion of the closing member and the fixing portion so as to be covered by the outside portion of the closing member. Further, it is possible to arrange the substantial structure (engaging and positioning structures or inside structure for fixing) for fixing the closing member to the slider body so as to be covered by the outside portion of the closing member and the engaging portion and not to be exposed to the outside. Thereby, the above engaging and positioning structures become difficult to be seen from the outside. In this way, by covering the locking and positioning structures between the engaging portion of the closing member and the fixing portion with the outside portion and the engaging portion of the closing member, it is possible to give the overall appearance of the pull tab connecting part including the closing member a unity by matching the appearance of the closing member to the appearance of the pull tab connecting post.

DESCRIPTION OF EMBODIMENTS

Figure 1:
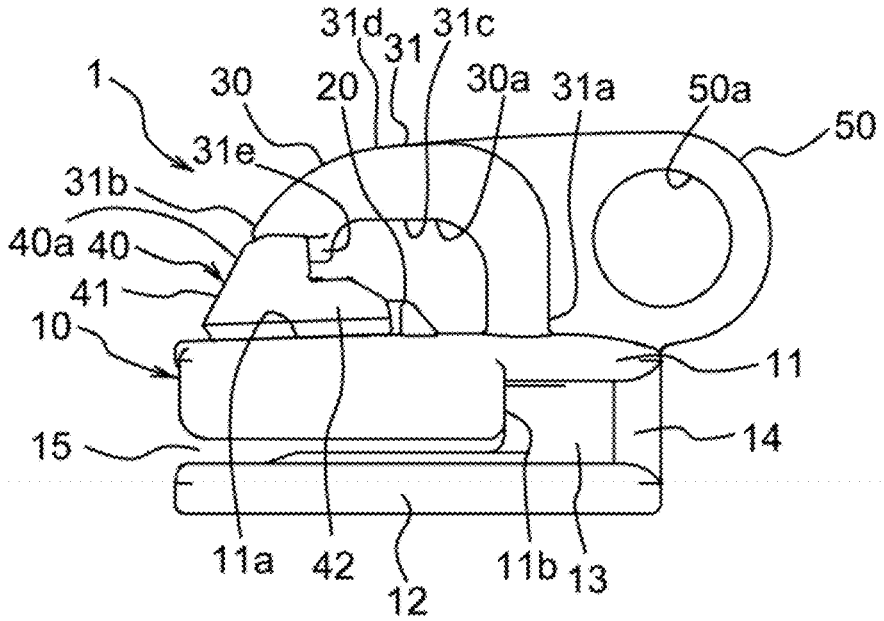
FIG. 1 is a side view of a slider according to a first embodiment of the present invention.
Figure 2:
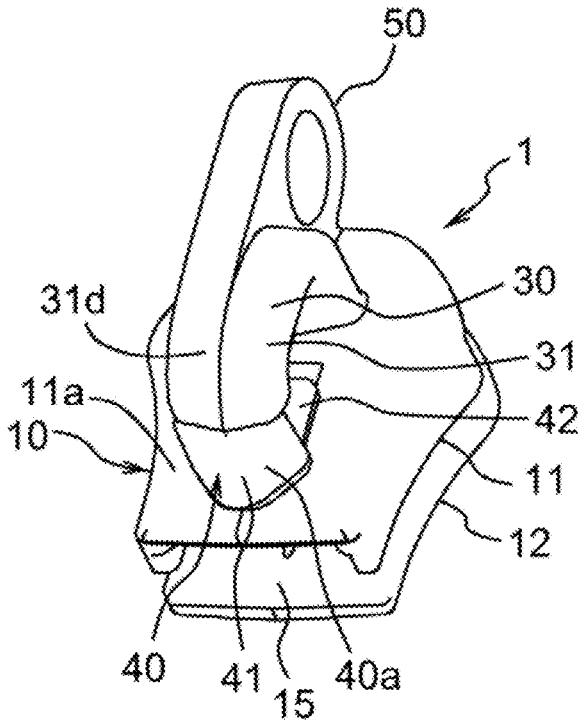
FIG. 2 is a perspective view of the slider in FIG. 1.
Figure 3:
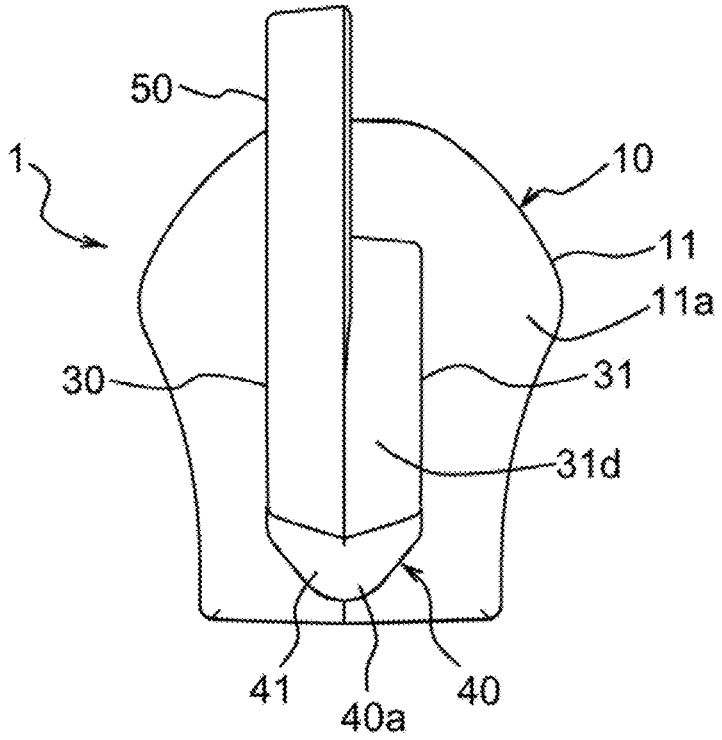
FIG. 3 is a top view of the slider in FIG. 1.
Figure 4:
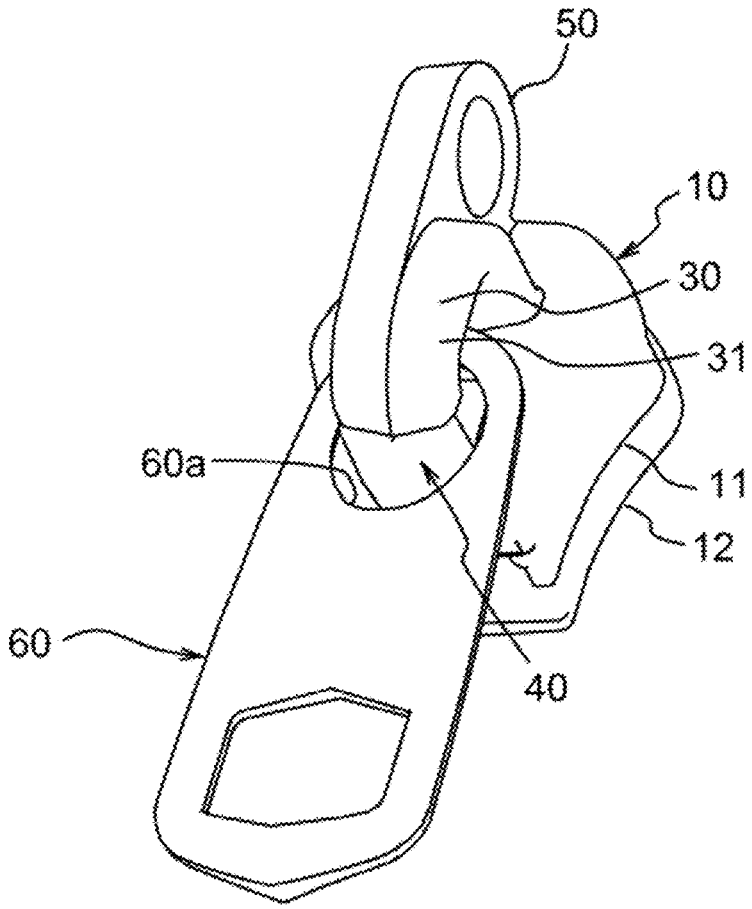
FIG. 4 is a perspective view, similar to FIG. 2, in a state where a pull tab is connected to the pull tab connecting part.

Hereinafter, some embodiments of a slider for a slide fastener according to the present invention will be described with reference to the drawings, but the present invention is not limited to such embodiments, and modifications and the like can be appropriately made within the scope of the claims and the range of equivalents. FIGS. 1 to 3 are a side view, a perspective view and a top view showing a slider 1 according to the first embodiment of the present invention. The slider 1 comprises a slider body 10 and a semi-annular pull tab connecting part 30 provided on the slider body 10 for connecting a pull tab 60 (see FIG. 4). FIG. 4 is a perspective view, similar to FIG. 2, showing a state where the pull tab 60 is connected to the pull tab connecting part 30. The pull tab connecting part 30 and the upper surface 11*a* of the slider body 10 define a closed pull tab connecting hole 30*a* that is penetrated in the width direction for connecting the pull tab 60. The slider 1 can close a fastener chain not shown by moving to one direction in the longitudinal direction (to the right based on FIG. 1) of the fastener chain and can open the fastener chain by moving to the other direction in the longitudinal direction (to the left based on FIG. 1). In this specification, the longitudinal direction of the slider 1 is the same as the longitudinal direction of the fastener chain, and the left-and-right direction based on FIG. 1 is the longitudinal direction of the slider 1. Hereinafter, the right based on FIG. 1 is also referred to as the front and the left is also referred to as the rear. The width direction of the slider 1 is the left-and-right direction based on FIG. 3. According to the present embodiment, the slider 1 further comprises a keyhole portion 50 that is adjacent to the front end of the pull tab connecting part 30 on the slider body 10 and that defines a keyhole 50*a*.

The slider body 10 comprises an upper blade 11, a lower blade 12, and a guide post 13 that connects between the respective front sides of the upper and lower blades 11, 12. Between the upper and lower blades 11, 12, there are defined two shoulder openings 14 open on both sides, in the width direction, of the guide post 13; a rear opening 15 open rearward; and a substantially Y-shaped element path connecting the shoulder openings 14 to the rear opening 15. Reference numeral 11*b* in FIG. 1 is an upper flange portion that protrudes downward from each of both sides, in the width direction, of the upper blade 11 and that keeps elements of the fastener chain from going out of the element path.

Figure 5:
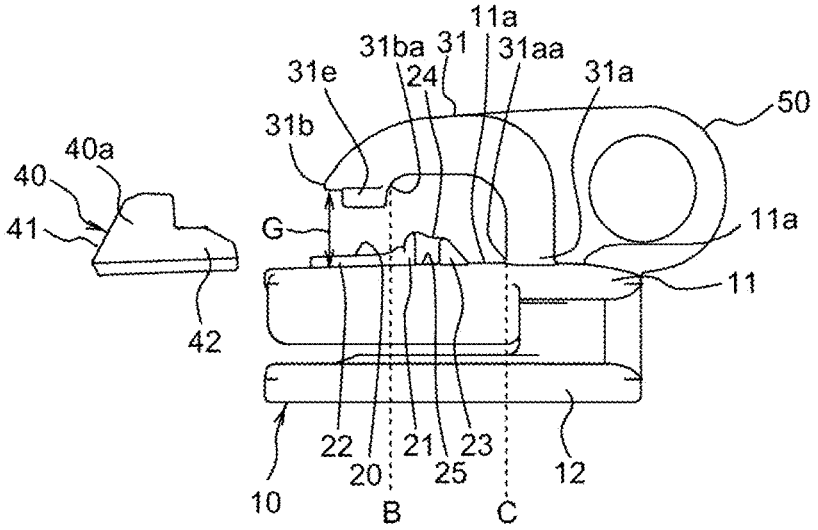
FIG. 5 is a side view of the slider showing a state where the closing member is separated.

The pull tab connecting part 30 comprises a cantilevered pull tab connecting post 31, in which one end portion (proximal portion) 31*a* is fixed to the upper surface 11*a* of the upper blade 11 and the other end portion (free end portion) 31*b* is separated from the upper surface 11*a*; and a closing member 40, which can be detachably attached to between the other end portion 31*b* of the pull tab connecting post 31 and the upper surface 11*a* of the upper blade 11 (see the gap G in FIG. 5). The pull tab connecting part 30 is provided on the slider body 10 at the midpoint in the width direction. In this embodiment, the closing member 40 is a component that can be detached as well as be replaced. The proximal portion 31*a* of the pull tab connecting post 31 is located frontward from the midpoint in the longitudinal direction on the upper surface 11*a* of the upper blade 11. The pull tab connecting post 31 rises upward from the proximal portion 31*a*, bends and extends rearward in a curved manner, and then further bends downward to terminate at the other end portion 31*b*. Before the closing member 40 is attached, there is a gap G (see FIG. 5) between the other end portion 31*b* of the pull tab connecting post 31 and the upper surface 11*a* of the upper blade 11, and the pull tab connecting hole 30*a* is not closed. A pull tab hole 60*a* of the pull tab 60 is passed through the gap G to be put over the pull tab connecting post 31, and then the closing member 40 is attached to fill the gap G. Thereby, the pull tab connecting hole 30*a* is closed, and the pull tab 60 is connected to the pull tab connecting part 30 as shown in FIG. 4. As will be described later in detail, the closing member 40 is fixed to a predetermined position shown in FIG. 1, etc. by engaging with a fixing portion 20 provided on the upper surface 11*a* of the upper blade 11. In this embodiment, the pull tab connecting post 31 is a die-cast part made of a metal such as a zinc alloy or an aluminum alloy and integrally formed with the upper blade 11. The closing member 40 is a molded part made of a thermoplastic resin such as polyacetal, polyamide, polypropylene, polybutylene terephthalate or the like, but not limited thereto. The pull tab connecting post 31 has an inner surface 31*c* facing the upper surface 11*a* of the upper blade 11, and an outer surface 31*d* that is substantially the surface other than the inner surface 31*c*. The outer surface 31*d* curves downward from the midpoint in the width direction to both sides so as to connect to the inner surface 31*c*. The keyhole portion 50 rises in front of the pull tab connecting post 31 on the upper surface 11*a* of the upper blade 11 and, as shown in FIG. 3, etc., extends frontward (upward based on FIG. 3) from the left half of the pull tab connecting post 31 beyond the front end of the slider body 10. A padlock or the like can be locked in the keyhole 50*a* of the keyhole portion 50.

Figure 6:
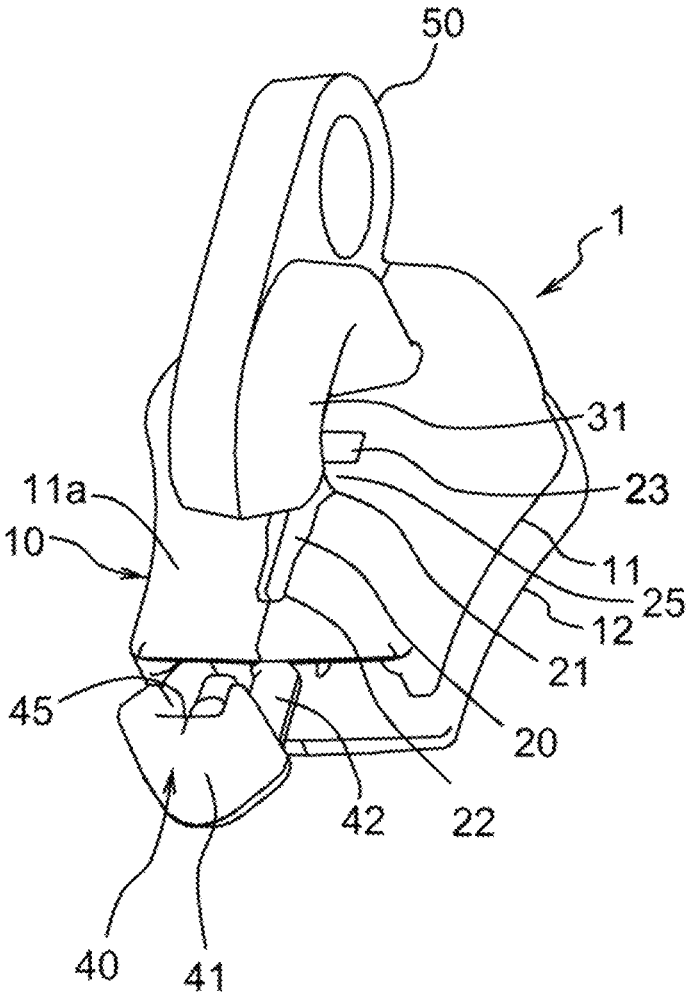
FIG. 6 is a perspective view of the slider in FIG. 5.
Figure 7:
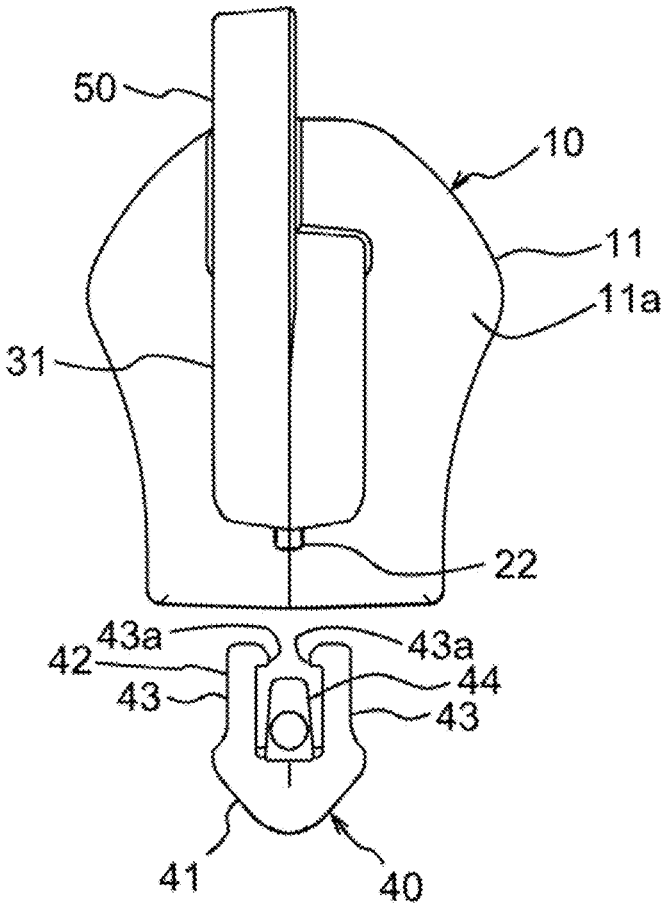
FIG. 7 is a top view of the slider in FIG. 5.

FIGS. 5 to 7 are a side view, a perspective view, and a top view of the slider 1 showing a state before the closing member 40 is attached. The closing member 40 comprises a cover portion 41 as an outside portion that defines an outside surface 40*a* facing rearward, and an engaging portion 42 that is provided on the front back of the cover portion 41 and that is detachably engageable with the fixing portion 20. The outside surface 40*a* is a curved surface that is convex rearward and has no recesses or cuts. The outside surface 40*a* of the cover portion 41 is designed to match with the outer surface 31*d* of the pull tab connecting post 31 in a state where the closing member 40 is attached to the slider body 10 at the predetermined position. In other words, in the state where the closing member 40 is attached to the slider body 10 at the predetermined position, the outside surface 40*a* of the cover portion 41 is continuous with the outer surface 31*d* of the pull tab connecting post 31 without any recesses or cuts, having an appearance as if the outer surface 31*d* of the pull tab connecting post 31 were extended rearward and downward. Thereby, the overall appearance of the pull tab connecting part 30 composed of the pull tab connecting post 31 and the closing member 40 is integrated into a unity. Since the cover portion 41 including the outside surface 40*a* of the closing member 40 has substantially the same configuration as an outside portion 141 including an outside surface 140*a* of a closing member 140 in a slider 101 according to the second embodiment described later, regarding the cover portion 41 including the outside surface 40*a*, the descriptions below regarding the outside portion 141 also substantially apply to the cover portion 41.

With reference to FIG. 7, etc., the engaging portion 42 of the closing member 40 includes a pair of lock legs 43 in the width direction extending frontward, in parallel, from the front inside of the cover portion 41, and the lock legs 43 are flexible portions. A lock claw 43*a* is provided at the front end of each of the lock legs 43, and each lock claw 43*a* protrudes in the direction close to each other. It can be said that the lock claws 43*a* protruding from the pair of the lock legs 43 in the direction close to each other are arranged between the pair of the lock legs 43. Further, on the front inside of the cover portion 41 between the pair of the lock legs 43, there is provided a positioner receiving portion 44 that receives a positioner 22 (see FIG. 6, etc.) of the fixing portion 20 in a close-fitting manner as described later. In this embodiment, the positioner 22 of the fixing portion 20 and the positioner receiving portion 44 of the closing member 40 constitute the positioner in the claims. With reference to FIG. 5, a convex portion 31*e* protruding downward is provided on the other end portion 31*b* of the pull tab connecting post 31. On the other hand, with reference to FIG. 6, a concave portion 45 is provided in an upper end portion on the front inside of the cover portion 41 of the closing member 40, and the concave portion 45 can engage with the convex portion 31*e* of the pull tab connecting post 31 when the closing member 40 is attached.

Figure 8:
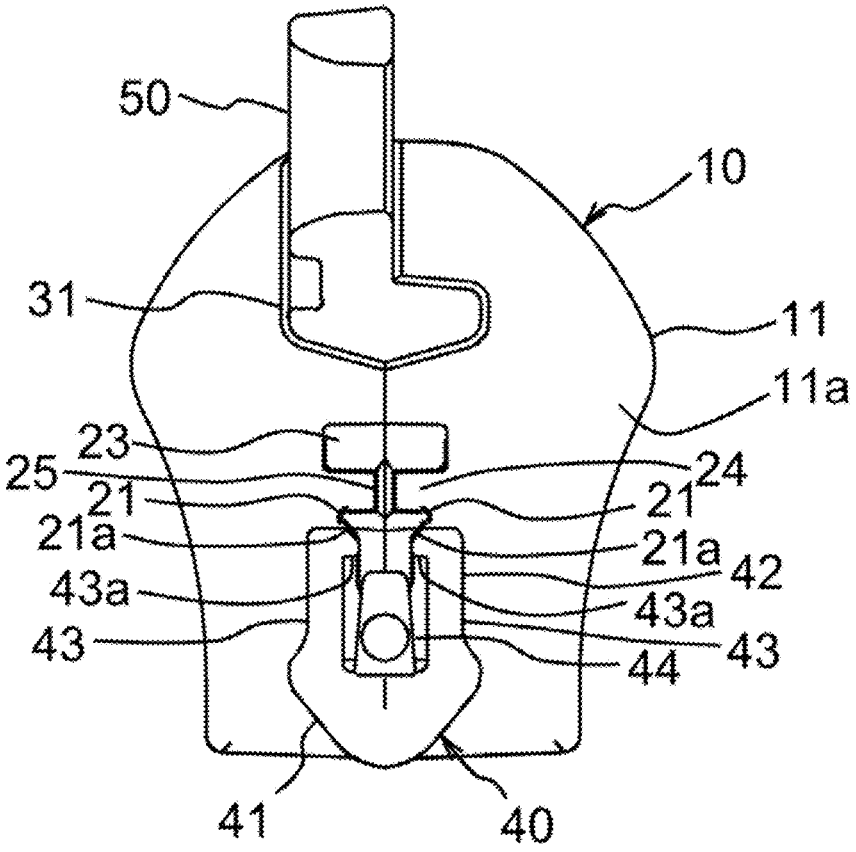
FIG. 8 is a top view of the slider, showing a state immediately before the closing member is completely attached, with the pull tab connecting post, etc. being cut away.

FIG. 8 is a top view of the slider 1 showing a state immediately before the closing member 40 is completely attached, with the pull tab connecting post 31 and the keyhole portion 50 being cut away. With reference to FIGS. 5, 6, 8, etc., a main part of the fixing portion 20 is provided so as to be raised on the upper surface 11*a* of the upper blade 11 along the longitudinal direction and at the midpoint in the width direction. The fixing portion 20 includes a pair of locking portions 21 in the width direction, which can receive and lock the lock claws 43*a* of the pair of the lock legs 43 of the closing member 40. Each of the locking portions 21 has an inclined side surface 21*a* (see FIG. 8) that gradually protrudes frontward in the longitudinal direction and outward in the left-and-right direction. The fixing portion 20 includes the positioner 22 that extends from the locking portions 21 to the rear end of the fixing portion 20 so as to be slightly narrowed. Further, the fixing portion 20 includes a stopper 23 that is elongated in the width direction and that is located frontward from the locking portions 21. Between the stopper 23 and the locking portions 21, an intermediate raised portion 24 and lock claw receiving portions 25 are provided. The intermediate raised portion 24 is raised along the longitudinal direction at the midpoint in the width direction and connects between the stopper 23 and the locking portions 21. The lock claw receiving portions 25 are non-raised space portions on both sides, in the width direction, of the intermediate raised portion 24. The intermediate raised portion 24 and the lock claw receiving portions 25 are also included in the fixing portion 20. As described above, the fixing portion 20 includes the locking portions 21, the positioner 22, the stopper 23 and the intermediate raised portion 24 as the portions that are raised from the upper surface 11*a* of the upper blade 11; and includes the lock claw receiving portions 25 as the space portions that are not raised from the upper surface 11*a*. It can be said that both of the portions that are raised from the upper surface 11*a* and the space portions that are not raised are located higher than the upper surface 11*a*. With reference to FIG. 5, the locking portions 21, the stopper 23, the intermediate raised portion 24 and the lock claw receiving portions 25 of the fixing portion 20 are arranged, in the longitudinal direction, between an edge 31*ba* on the one end portion 31*a*-side in the other end portion 31*b* of the pull tab connecting post 31 and an edge 31*aa* on the other end portion 31*b*-side in the one end portion 31*a* of the pull tab connecting post 31. In other words, the locking portions 21, the stopper 23, the intermediate raised portion 24 and the lock claw receiving portions 25 are located between the vertical line B passing through the edge 31*ba* and the vertical line C passing through the edge 31*aa*; and the locking portions 21, the stopper 23, the intermediate raised portion 24 and the lock claw receiving portions 25 extend beyond the vertical line B toward the one end portion 31*a*. The positioner 22 of the fixing portion 20 is located substantially rearward from the vertical B in the longitudinal direction. In this embodiment, the fixing portion 20 except for the lock claw receiving portions 25 is a metal die-cast portion formed integrally with the upper blade 11, but not limited thereto, and may be a portion made of resin added to the upper blade 11.

Figure 9:
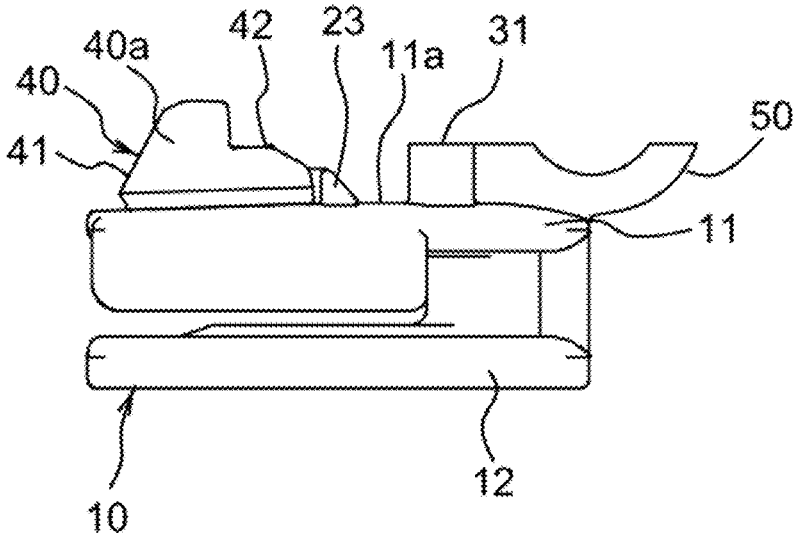
FIG. 9 is a side view of the slider, showing a state where the closing member is completely attached, with the pull tab connecting post, etc. being cut away.
Figure 10:
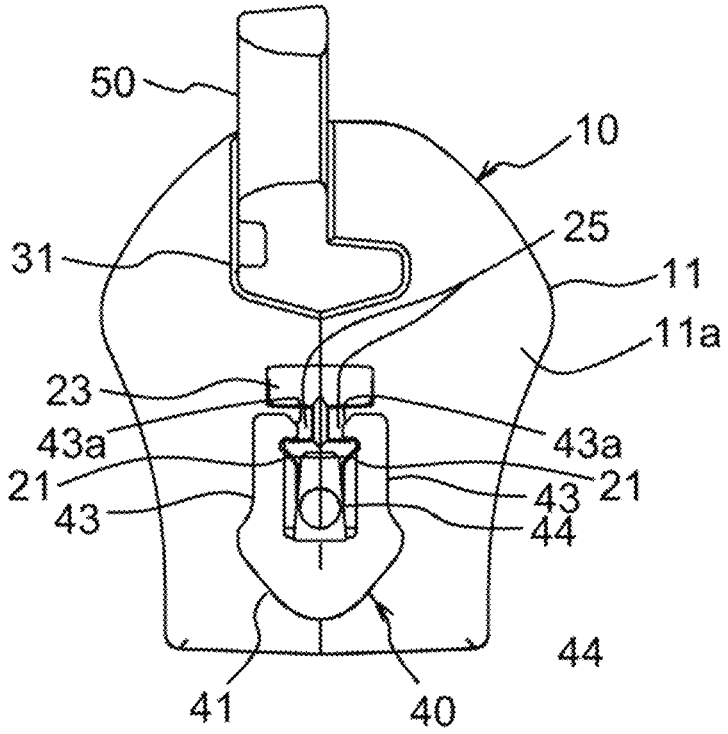
FIG. 10 is a top view of the slider in FIG. 9.

To attach the closing member 40, the closing member 40 is inserted to the gap G between the pull tab connecting post 31 and the upper surface 11*a* of the slider body 10 frontward from the rear side of the slider body 10 in the longitudinal direction along the upper surface 11*a*. At this time, the pair of the lock legs 43 of the closing member 40 temporarily bend outward in the width direction by the lock claws 43*a* contacting the inclined side surfaces 21*a* of the pair of the locking portions 21 of the fixing portion 20. Then, upon the lock claws 43*a* have passed over the inclined side surfaces 21*a*, each of the lock legs 43 returns back, whereby the lock claws 43*a* are received and locked by the locking portions 21. At this time, each of the lock claws 43*a* is received in each of the lock claw receiving portions 25 of the fixing portion 20 (see FIG. 10). In this way, the lock claws 43*a* are locked by the locking portions 21 by utilizing the flexibility, in the width direction, of the lock legs 43. At the same time, the positioner 22 of the fixing portion 20 is received in the positioner receiving portion 44 of the closing member 40 in a close-fitting manner, and whereby the closing member 40 is restrained in this position. FIGS. 9 and 10 are a side view and a top view of the slider 1 showing a state where the closing member 40 is completely attached, with the pull tab connecting post 31 and the keyhole portion 50 being cut away. In addition, when the closing member 40 is attached, the front ends of the lock legs 43 of the closing member 40 come close to or in contact with the stopper 23 of the fixing portion 20, and thereby the closing member 40 is kept from further moving frontward. Further, the convex portion 31*e* of the pull tab connecting post 31 engages with the concave portion 45 of the closing member 40. As described above, the closing member 40 is fixed at the predetermined position on the slider body 10. It should be noted that the fixing of the closing member 40 is substantially done only by the engagement between the engaging portion 42 of the closing member 40 and the fixing portion 20. The engagement between the convex portion 31*e* of the pull tab connecting post 31 and the concave portion 45 of the closing member 40 is for the purpose of aligning them in a non-fixed manner, where the convex portion 31*e* and the concave portion 45 are not connected to each other. That is, it can be said that the structure for fixing the closing member 40 to the slider body 10 in the slider 1 includes the locking structure between the lock claws 43*a* and the locking portions 21 and the positioning structure in the engagement between the positioner 22 and the positioner receiving portion 44. In this embodiment, the closing member 40 can be removed by pulling it rearward with a certain force or more so that the lock claws 43*a* are disengaged from the locking portions 21. However, it is possible to make the closing member 40 non-removable unless it is destroyed, for example, and to attach a new closing member 40 after the destruction or the like. In the slider 1 described above, the engaging portion 42 including the pair of the lock legs 43 of the closing member 40 is provided on the front back of the cover portion 41, and the fixing portion 20 is also provided on the front back side of the closing member 40 located at the attachment position. Therefore, the engaging portion 42 of the closing member 40 and the fixing portion 20 are covered and hidden by the cover portion 41 of the closing member 40. Further, the lock claws 43*a*, the locking portions 21, the positioner 22 and the positioner receiving portion 44, which are the locking and positioning structures for fixing the closing member 40, are covered and hidden by the cover portion 41 of the closing member 40 and the lock legs 43 of the engaging portion 42. Therefore, the locking and positioning structures are not exposed to the outside, and it is difficult to see them from the outside. Further, in the slider 1, the fixing portion 20 extends frontward in the longitudinal direction (toward the guide post 13) beyond the vertical line B (see FIG. 5), and the engaging portion 42 of the closing member 40 in the attached state also extends frontward in the longitudinal direction beyond the vertical line B. In this way, by extending, in the longitudinal direction, the fixing portion 20 and the engaging portion 42 of the closing member 40, which are engaged with each other, when a user pulls the pull tab 60 connected to the pull tab connecting part 30, it is possible to easily secure the strength against that pull. Further, it becomes easy to cover the locking and positioning structures between the engaging portion 42 and the fixing portion 20 described above by the cover portion 41 and the lock legs 43. Furthermore, in the state where the closing member 40 is attached, the closing member 40 and the other end portion (free end portion) 31*b* of the pull tab connecting post 31 are not connected to each other but simply aligned. Therefore, it is not necessary to complicate the configurations of the other end portion 31*b* of the pull tab connecting post 31 and an upper portion of the closing member 40 that corresponds to the other end portion 31*b*.

Figure 11:
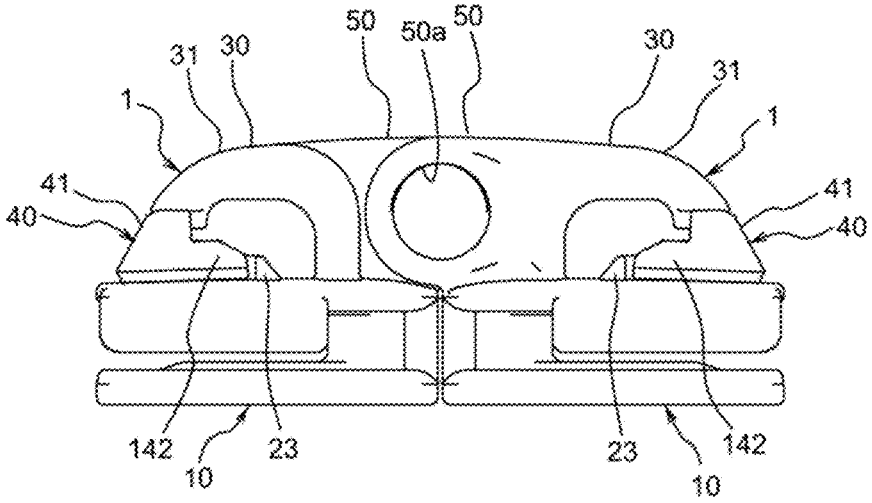
FIG. 11 is a side view showing a state where the respective guide post-side ends of two sliders are abutted on each other.
Figure 12:
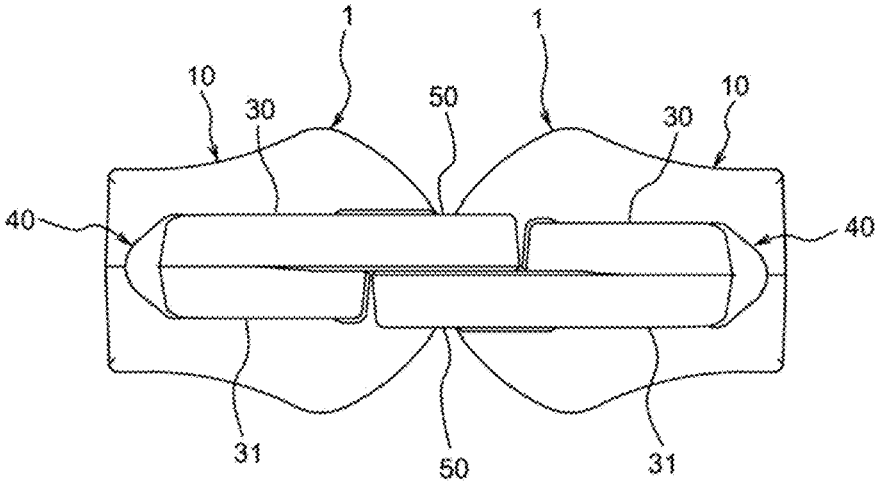
FIG. 12 is a top view of the sliders in FIG. 11.

FIGS. 11 and 12 are a side view and a top view showing a state where two sliders 1 described above are attached to a common fastener chain (not shown) in longitudinally opposite directions to each other, and the respective guide post 13—side ends are abutted (hereinafter referred to as "the abutted state") on each other. The slider 1 is designed such that, in the abutted state of the sliders 1, the respective keyholes 50*a* of the keyhole portions 50 of the sliders 1 overlap in the width direction. By locking a padlock (not shown) or the like in the keyholes 50*a* in the abutted state, it becomes hard to move the two sliders 1 away from each other in the fastener chain, so that the fastener chain cannot be opened.

Figure 13:
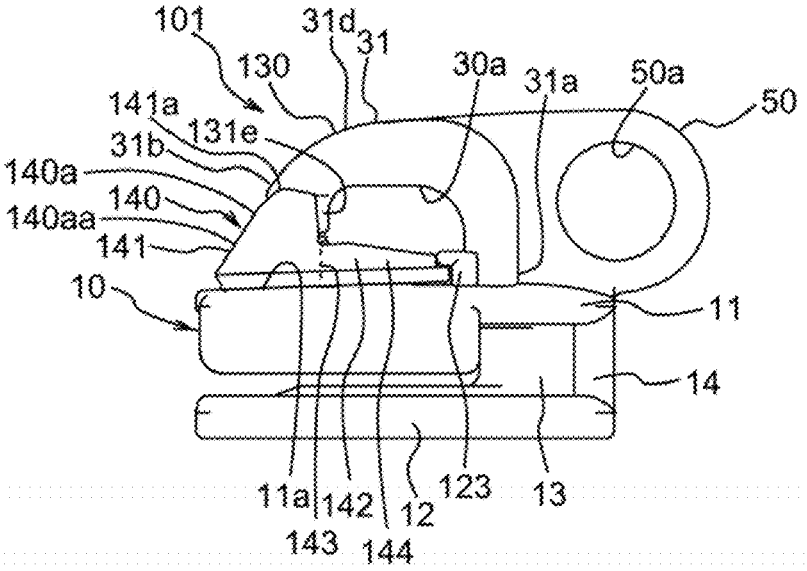
FIG. 13 is a side view of a slider according to a second embodiment of the present invention.
Figure 14:
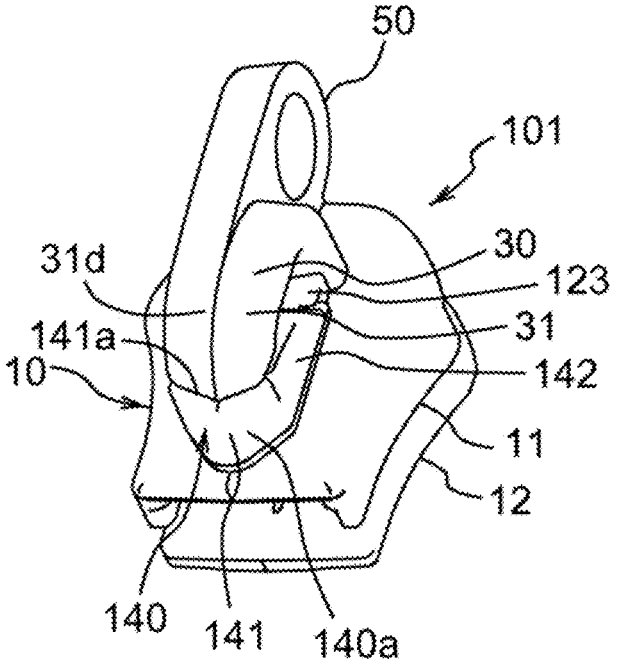
FIG. 14 is a perspective view of the slider in FIG. 13.

Next, the slider 101 according to the second embodiment of the present invention will be described. Main differences between the slider 101 and the slider 1 described above are the closing member 140 and the fixing portion 120 as described later, and the slider body 10, the pull tab connecting post 31 (except for a convex portion 131*e* as described later) and the keyhole portion 50 are substantially the same as those in the slider 1. Therefore, the same reference numerals as in the slider 1 are used for the slider body 10, the pull tab connecting post 31 (except for a convex portion 131*e*) and the keyhole portion 50. FIGS. 13 and 14 are a side view and a perspective view of the slider 101. The top view of the slider 101 is substantially the same as FIG. 3 showing the top view of the slider 1. The slider 101 comprises the slider body 10 and a semi-annular pull tab connecting part 130 provided on the slider body 10 for connecting the pull tab 60 (see FIG. 4). The pull tab connecting part 130 and the upper surface 11*a* of the slider body 10 define a pull tab connecting hole 130*a*. The pull tab connecting part 130 comprises the cantilevered pull tab connecting post 31, in which one end portion (proximal portion) 31*a* is fixed to the upper surface 11*a* of the upper blade 11, and a closing member 140, which can be detachably attached to between the other end portion 31*b* of the pull tab connecting post 31 and the upper surface 11*a* of the upper blade 11. The closing member 140 is a component that can be detached as well as be replaced. The closing member 140 is fixed to a predetermined position shown in FIG. 13, etc. by engaging with the fixing portion 120 provided on the upper surface 11*a* of the upper blade 11. The length of the closing member 140 in the longitudinal direction is longer than that of the closing member 40 of the first embodiment, and particularly, the length of the engaging portion 142 in the longitudinal direction is longer than the engaging portion 42. Further, the length, in the longitudinal direction, of the fixing portion 120 as described later is also longer than the fixing portion 20 of the first embodiment.

Figure 15:
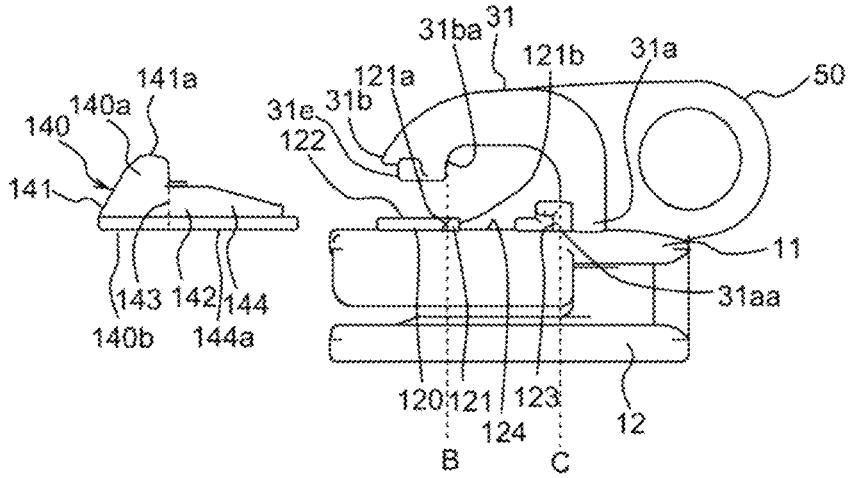
FIG. 15 is a side view of the slider showing a state where the closing member is separated.
Figure 16:
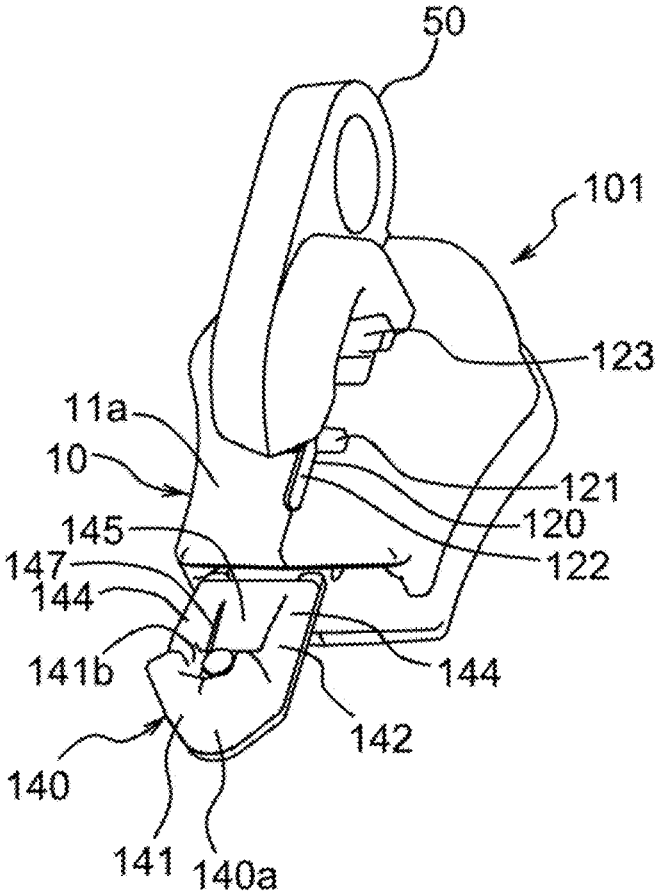
FIG. 16 is a perspective view of the slider in FIG. 15.
Figure 17:
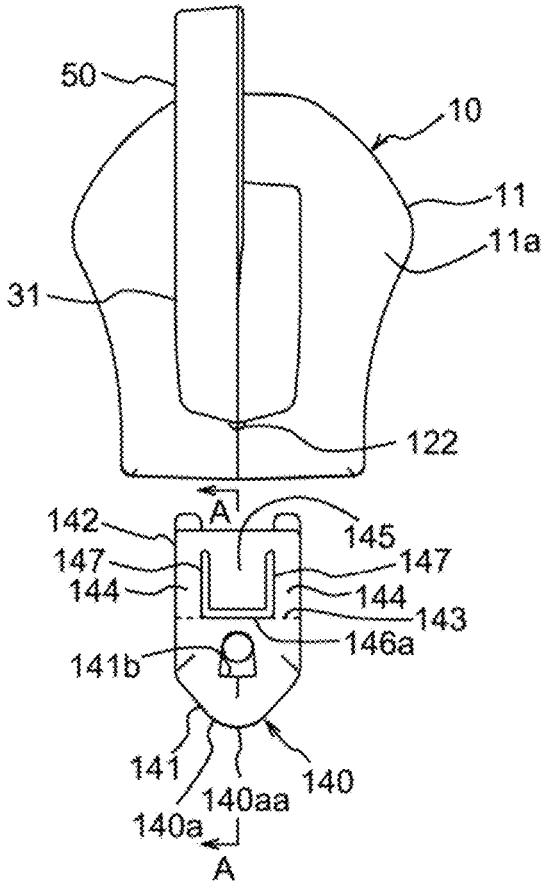
FIG. 17 is a top view of the slider in FIG. 15.

FIGS. 15 to 17 are a side view, a perspective view and a top view of the slider 101 showing a state before the closing member 140 is attached, with the closing member 140 being separated. With reference to these drawings, the fixing portion 120 provided on the upper surface 11*a* of the slider body 10 includes a locking portion 121 that is elongated in the width direction, a positioner 122 that extends rearward from the midpoint, in the width direction, of the locking portion 121, and a stopper 123 that is elongated in the width direction and is separated frontward, in the longitudinal direction, from the locking portion 121. The locking portion 121, the positioner 122 and the stopper 123 are provided so as to be raised from the upper surface 11*a*. The fixing portion 120 includes a lock claw receiving portion 124, which is a non-raised space portion, between the locking portion 121 and the stopper 123. In this way, the fixing portion 120 includes the locking portion 121, the positioner 122 and the stopper 123 as the portions that are raised from the upper surface 11*a* of the upper blade 11; and includes the lock claw receiving portion 124 as the space portion that is not raised from the upper surface 11*a*. It can be said that both of the portions that are raised from the upper surface 11*a* and the space portion that is not raised are located higher than the upper surface 11*a*. With reference to FIG. 15, the locking portion 121, the lock claw receiving portion 124 and the stopper 123 (except for its front end portion) of the fixing portion 120 are arranged, in the longitudinal direction, between the edge 31*ba* on the one end portion 31*a*-side in the other end portion 31*b* of the pull tab connecting post 31 and the edge 31*aa* on the other end portion 31*b*-side in the one end portion 31*a* of the pull tab connecting post 31. In other words, the locking portion 121, the lock claw receiving portion 124 and the stopper 123 except for its front end portion are located between the vertical line B passing through the edge 31*ba* and the vertical line C passing through the edge 31*aa*; and extend beyond the vertical line B toward the one end portion 31*a*. The positioner 122 of the fixing portion 120 is arranged rearward from the vertical line B in the longitudinal direction. The locking portion 121 has an inclined surface 121*a* that faces rearward and inclines upward and frontward, and a vertical surface 121*b* that faces frontward. The stopper 123 is provided adjacent to the edge 31*aa* on the other end portion 31*b*-side in the proximal portion (one end portion) 31*a* of the pull tab connecting post 31.

Figure 18:
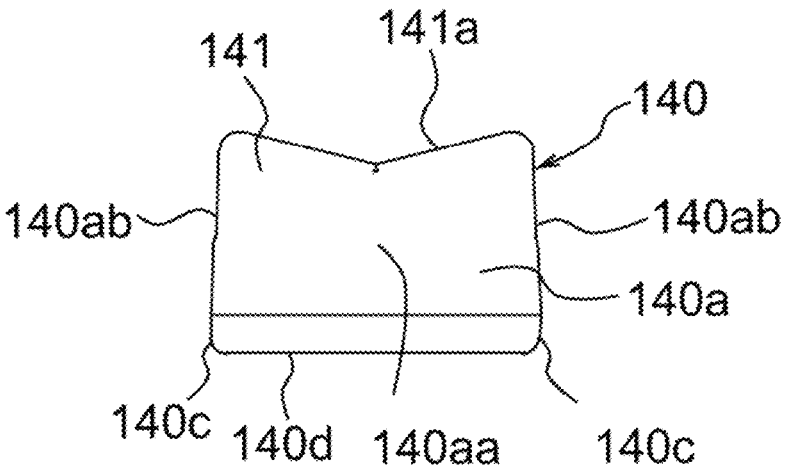
FIG. 18 is a front view of a closing member as viewed from the rear side in the longitudinal direction.
Figure 19:
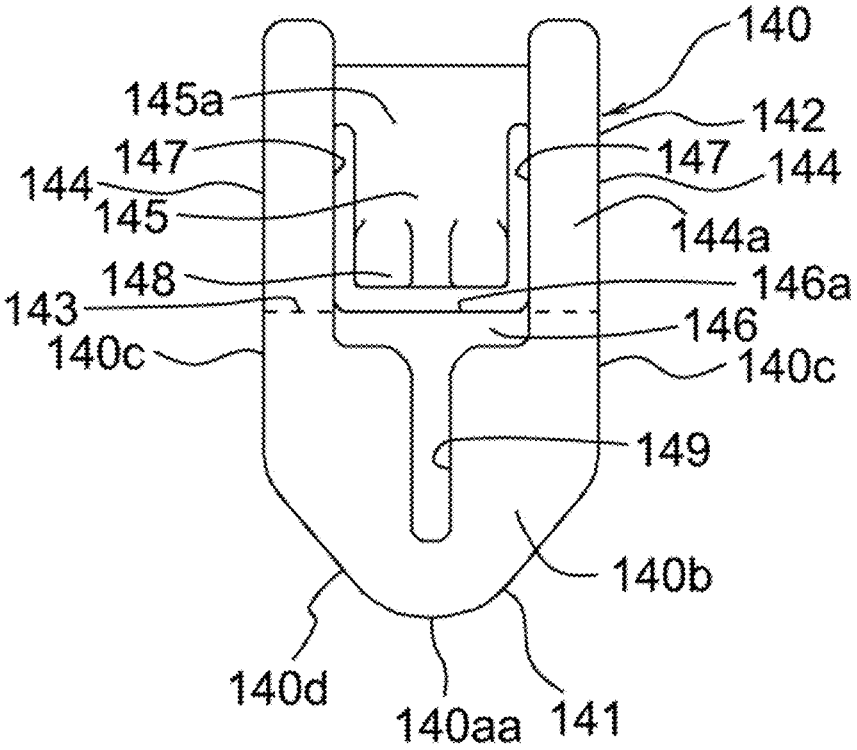
FIG. 19 is a bottom view of the closing member.

With reference to FIGS. 15 to 17, the closing member 140 comprises an outside portion 141 defining an outside surface 140*a* facing rearward (leftward based on FIG. 15) in the longitudinal direction, and an engaging portion 142 that extends frontward (rightward based on FIG. 15), in the longitudinal direction, from the outside portion 141 and that is detachably engageable with the fixing portion 120. The broken line 143 in FIG. 15, etc. conveniently indicates a boundary 143 between the outside portion 141 and the engaging portion 142 in the longitudinal direction. In other words, the boundary 143 is the front end 143 (in the longitudinal direction) of the outside portion 141 as well as the rear end 143 (in the longitudinal direction) of the engaging portion 142. With reference to FIG. 15, etc., the outside portion 141 protrudes upward from the engagement portion 142, and the reference numeral 141*a* indicates an upper end portion of the outside portion 141. FIG. 18 is a front view of the closing member 140 as viewed from the rear side in the longitudinal direction. FIG. 19 is a bottom view of the closing member 140. With reference to FIG. 19, the peripheral edge of the bottom surface 140*b* of the outside portion 141 is composed of left and right edges 140*c*, which are parallel to each other, and a rear edge 140*d* that protrudes rearward (downward based on FIG. 19) from the rear ends of the left and right edges 140*c* so as to gradually narrow the width in the width direction and that is curved and convex rearward in a midpoint area, in the width direction, of the rear edge 140*d*. The outside surface 140*a* of the outside portion 141 is a surface that extends from the left and right edges 140*c* and the rear edge 140*d* to the upper end portion 141*a* of the outside portion 141, and is a gently curved surface that is convex rearward as a whole. A contour 140*aa* of the outside surface 140*a* when viewed laterally, namely, the middle point (140*aa*), in the width direction, of the outside surface 140*a* is shown in FIG. 15, etc. and the contour 140*aa* is inclined downward and rearward. With reference to FIG. 18, the outside surface 140*a* includes left and right faces 140*ab* extending upward from the left and right edges 140*c* of the bottom surface 140*b*. These left and right faces 140*ab* are almost parallel to each other, but the space in the width direction between the left and right faces 140*ab* slightly narrows upward. The outside surface 140*a* is a curved surface that gently protrudes rearward from the left and right faces 140*ab* to the middle point 140*aa* in the width direction and that has no recesses or cuts. Further, as can be seen from FIG. 18, the upper end portion 141*a* of the outside portion 141 is the highest on each side of the left and right faces 140*ab*, and is relatively lower at the midpoint in the width direction. Such the upper end portion 141*a* of the outside portion 141 is in close contact with the other end portion 31*b* of the pull tab connecting post 31 in the state where the closing member 140 is attached to the upper surface 11*a* of the slider body 10. The outside surface 140*a* of the outside portion 141 is designed to match with the outer surface 31*d* of the pull tab connecting post 31 in the state where the closing member 140 is attached. In other words, in the state where the closing member 140 is attached to the slider body 10 at the predetermined position, the outside surface 140*a* of the outside portion 141 is continuous with the outer surface 31*d* of the pull tab connecting post 31 without any recesses or cuts, having an appearance as if the outer surface 31*d* of the pull tab connecting post 31 were extended rearward and downward. Thereby, the overall appearance of the pull tab connecting part 130 composed of the pull tab connecting post 31 and the closing member 140 is integrated into a unity. Since the configuration of the outside portion 141 including the outside surface 140*a* described above is substantially the same as that of the cover portion 41 including the outside surface 40*a* of the closing member 40 in the slider 1 of the first embodiment, the configuration applies to the cover portion 41 as well.

Figure 20:
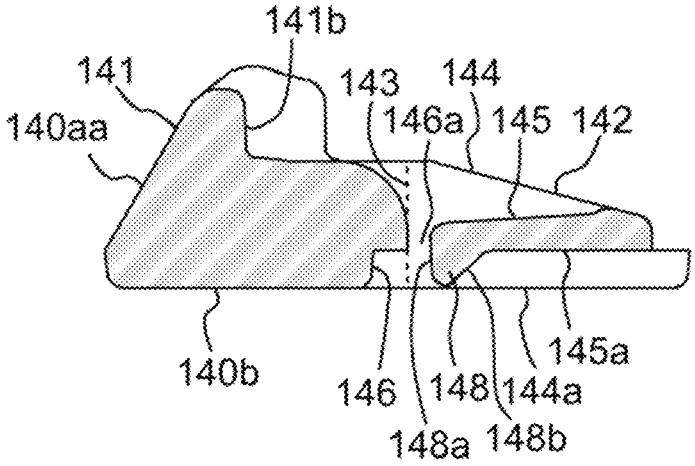
FIG. 20 is a cross-sectional view of the closing member taken along the line A-A in FIG. 17.

FIG. 20 is a cross-sectional view of the closing member 140 taken along the line A-A in FIG. 17. With reference to FIGS. 20 and 15 to 19, the engaging portion 142 of the closing member 140 comprises a pair of legs 144 in the width direction extending frontward from the front end 143 of the outside portion 141 in parallel, and a thin plate-like leaf spring 145 as a flexible portion that connects between the pair of the legs 144 near the bottom surface 140*b* of the closing member 140. The bottom surface 144*a* of each of the legs 144 is flush with the bottom surface 140*b* of the outside portion 141, while the bottom surface 145*a* of the leaf spring 145 is located higher than the bottom surfaces 144*a* of the legs 144. Accordingly, the leaf spring 145 is recessed upward with respect to the bottom surfaces 144*a* of the left and right legs 144. Between the leaf spring 145 and the outside portion 141, there is provided a lock concave portion 146 for receiving the locking portion 121 of the fixing portion 120 in the state where the closing member 140 is attached. The lock concave portion 146 is recessed upward from the bottom surface 140*b* and is elongated in the width direction. A front half, in the longitudinal direction, of the lock concave portion 146 is a through hole 146*a* that communicates with the outside above the leaf spring 145. The degree of the recession from the bottom surface 140*b* of the lock concave portion 146 except for the through hole 146*a* is substantially the same as the degree of the recession of the leaf spring 145. There are provided bend auxiliary holes 147 extending frontward continuously from left and right ends of the through hole 146*a*. The front end (proximal end) of the leaf spring 145 is connected to the left and right legs 144, but the remaining portion other than the front end of the leaf spring 145 is separated from the left and right legs 144 by the left and right bend auxiliary holes 147. The bend auxiliary holes 147 promotes bending in the vertical direction, namely elastic displacement, of the leaf spring 145, when the closing member 140 is attached as described later. The leaf spring 145 includes a lock claw 148 at its rear end on the side of the through hole 146*a*, and the lock claw 148 protrudes below the bottom surface 145*a* of the leaf spring 145. The lock claw 148 has a vertical surface 148*a* facing rearward, which is a rear end surface of the leaf spring 145, and an inclined surface 148*b* facing frontward, which is inclined upward and frontward from the lower end of the vertical surface 148*a*. The lower end of the lock claw 148 is at the same vertical position as the bottom surface 140*b* of the outside portion 141. With reference to FIG. 19, etc., the front ends (upper ends based on FIG. 19) of the left and right legs 144 protrude frontward more than the front end of the leaf spring 145. Further, the bottom surface 140*b* of the outside portion 141 is provided with a concave shaped positioner receiving portion 149 that extends rearward from the midpoint, in the width direction, of the lock concave portion 146. The positioner receiving portion 149 can receive the positioner 122 of the fixing portion 120 in a close-fitting manner when the closing member 140 is attached. The positioner receiving portion 149 extends from the engaging portion 142 beyond the boundary 143 to the outside portion 141. In this embodiment, the positioner 122 of the fixing portion 120 and the positioner receiving portion 149 of the closing member 140 constitute the positioner in the claims. With reference to FIG. 15, etc., a convex portion 131*e* protruding downward is provided on the other end portion 31*b* of the pull tab connecting post 131. The convex portion 131*e* protrudes downward slightly further than the convex portion 31*e* of the first embodiment. On the other hand, with reference to FIG. 16, etc., a concave portion 141*b* is provided on the front inside of the outside portion 141 of the closing member 140, and the concave portion 141*b* can engage with the convex portion 131*e* of the pull tab connecting post 31 when the closing member 140 is attached.

Figure 21:
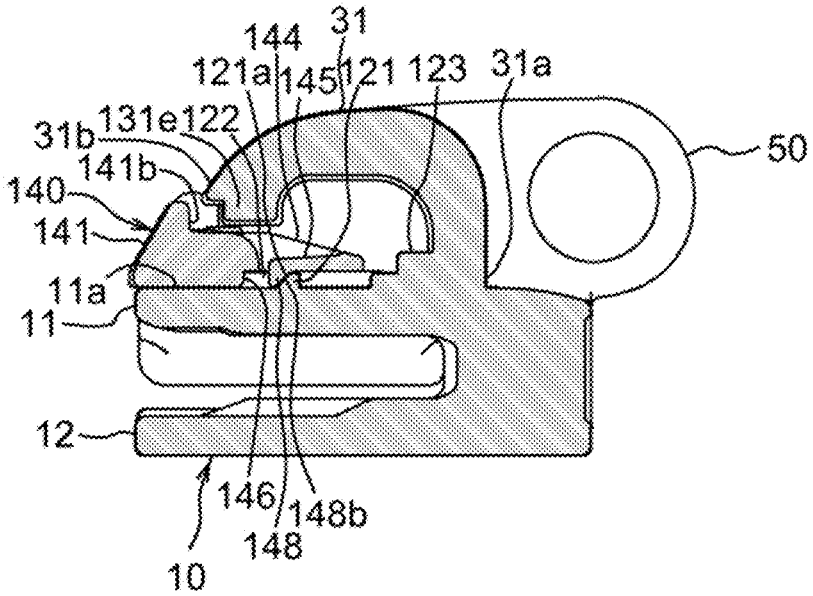
FIG. 21 is a cross-sectional view of the slider taken along the middle point in the width direction, showing a state immediately before the closing member is completely attached.
Figure 22:
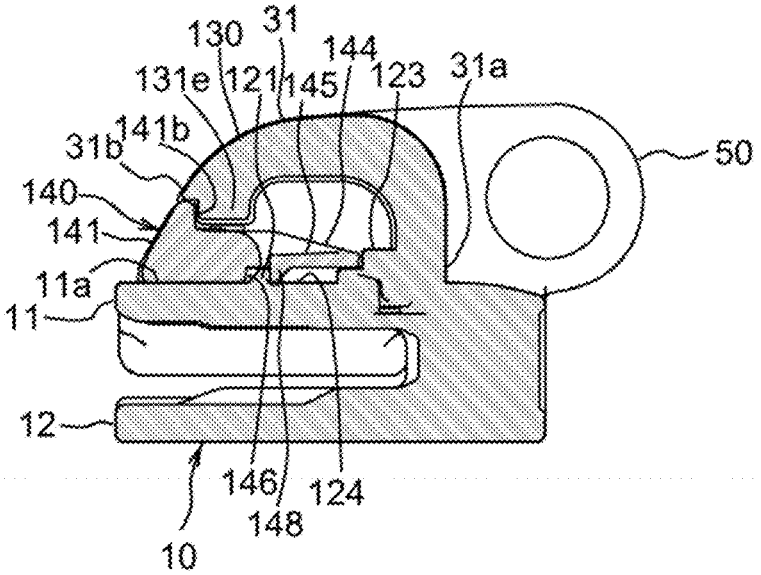
FIG. 22 is a sectional view, similar to FIG. 21, showing a state where the closing member is attached.
Figure 23:
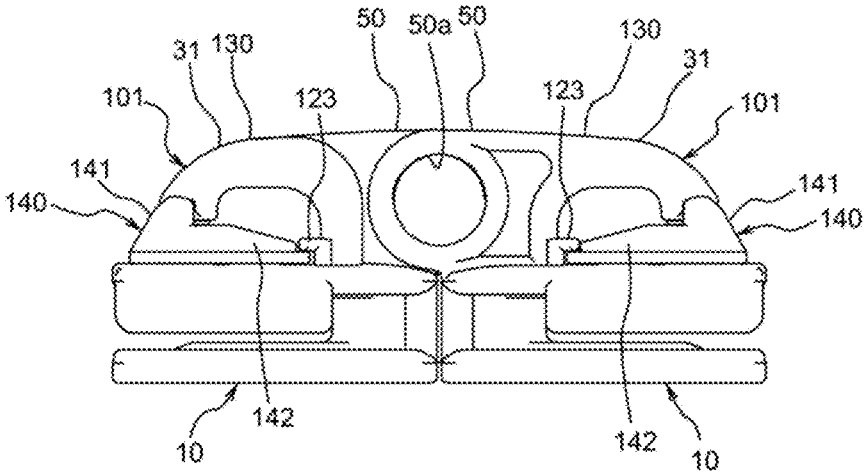
FIG. 23 is a side view showing a state where the respective guide post-side ends of two sliders are abutted on each other.

FIG. 21 is a cross-sectional view of the slider 101 taken along the middle point in the width direction, showing a state immediately before the closing member 40 is completely attached. FIG. 22 is a sectional view, similar to FIG. 21, showing a state where the closing member is attached. To attach the closing member 140, the closing member 140 is inserted to the gap between the pull tab connecting post 31 and the upper surface 11*a* of the slider body 10 frontward from the rear side of the slider body 10 in the longitudinal direction along the upper surface 11*a*. At this time, the lock claw 148 of the closing member 140 contacts the locking portion 121 of the fixing portion 120, and then the lock claw 148 passes over the locking portion 121 while the leaf spring 145 bends upward. At this time, the inclined surface 148*b* of the lock claw 148 slides on the inclined surface 121*a* of the locking portion 121, while the rear end of the leaf spring 145 is lifted upward. Then, upon the lock claw 148 has passed over the locking portion 121, the leaf spring 145 returns back downward (see FIG. 22), and thereby the lock claw 148 of the closing member 140 is locked by the locking portion 121, with the vertical surface 121*b* of the locking portion 121 and the vertical surface 148*a* of the lock claw 148 being in contact with each other. At this time, the lock claw 148 is received in the lock claw receiving portion 124 of the fixing portion 120. At the same time, the positioner 122 of the fixing portion 120 is received in the positioner receiving portion 149 of the closing member 140 in a close-fitting manner, and thereby the closing member 140 is restrained in this position. In this way, in this embodiment, the lock claw 148 can be locked by the locking portion 121 by utilizing the vertical bending of the leaf spring 145. At this time, the locking portion 121 of the fixing portion 120 is received in the lock concave portion 146 of the closing member 140. In addition, in the state where the closing member 140 is attached, the front ends of the left and right legs 144 of the closing member 140 are in contact with the stopper 123 of the fixing portion 120, and thereby the closing member 140 is kept from further moving frontward. Further, the convex portion 131*e* of the pull tab connecting post 31 engages with the concave portion 145 of the closing member 140. As described above, the closing member 140 is fixed at the predetermined position on the slider body 10. It should be noted that the fixing of the closing member 140 is substantially done only by the engagement between the engaging portion 142 of the closing member 140 and the fixing portion 120. The engagement between the convex portion 131*e* of the pull tab connecting post 31 and the concave portion 141*b* of the closing member 140 is for the purpose of aligning the closing member 140 and the fixing portion 120 in a non-fixed manner, where the convex portion 131*e* and the concave portion 141*b* are not connected to each other. In this embodiment, the closing member 140 can be removed by pulling it rearward with a certain force or more so that the lock claw 148 is disengaged from the locking portion 121. However, it is possible to make the closing member 140 non-removable unless it is destroyed, for example, and to attach a new closing member 140 after the destruction or the like. In the slider 101 described above, the fixing of the closing member 140 to the slider body 10 is done by the engagement between the engaging portion 142 of the closing member 140 and the fixing portion 120. In addition, the engaging portion 142 including the lock claw 148 of the closing member 140 is provided on the front back of the outside portion 141, and the fixing portion 120 is also provided on the front back side of the closing member 140 located at the attachment position. Therefore, the engaging portion 142 of the closing member 140 and the fixing portion 120 are covered and hidden by the outside portion 141 of the closing member 140. Further, the lock claw 148, the locking portion 121, the positioner 122 and the positioner receiving portion 149, which are the locking and positioning structures for fixing the closing member 140, are covered and hidden by the outside portion 141 of the closing member 140 and the left and right legs 144 of the engaging portion 142. Therefore, the locking and positioning structures are not exposed to the outside, and it is difficult to see them from the outside. Further, in the slider 101, the fixing portion 120 extends frontward in the longitudinal direction (toward the guide post 13) beyond the vertical line B (see FIG. 15), and the engaging portion 142 of the closing member 140 in the attached state also extends in the longitudinal direction beyond the vertical line B. In this way, by extending, in the longitudinal direction, the fixing portion 120 and the engaging portion 142 of the closing member 140, which are engaged with each other, when a user pulls the pull tab 60 connected to the pull tab connecting part 30, it is possible to easily secure the strength against that pull. Further, it becomes easy to cover the locking and positioning structures between the engaging portion 142 and the fixing portion 120 described above by the outside portion 141 and the legs 144. Furthermore, in the state where the closing member 140 is attached, the closing member 140 and the other end portion (free end portion) 31*b* of the pull tab connecting post 31 are not connected to each other but simply aligned. Therefore, it is not necessary to complicate the configurations of the other end portion 31*b* of the pull tab connecting post 31 and an upper portion of the closing member 140 that corresponds to the other end portion 31*b*.

Figure 24:
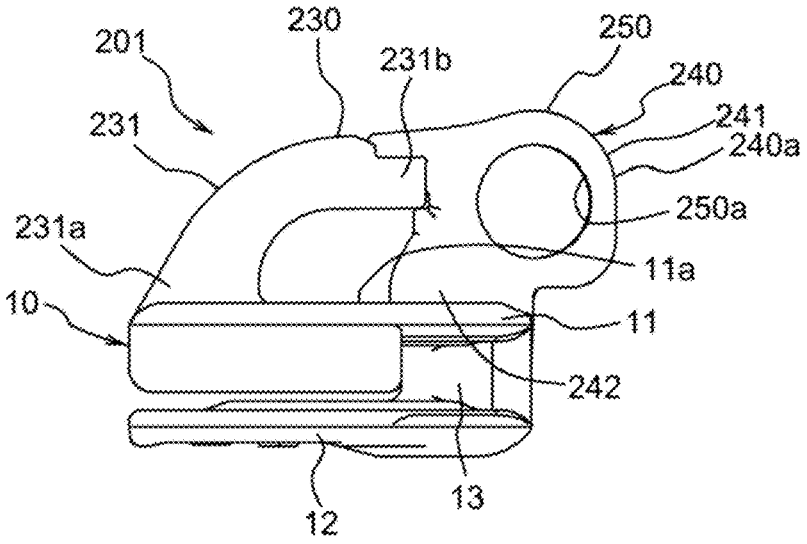
FIG. 24 is a side view of a slider according to another embodiment of the present invention.

The sliders 1, 101 described above are embodiments in which the closing members 40, 140 are attached to the rear side in the longitudinal direction (on the side opposite to the guide post 13), but the present invention is not limited thereto, and a closing member may be attached to the front side in the longitudinal direction. FIG. 24 is a side view showing a slider 201 according to another embodiment of the present invention. The slider 201 comprises a slider body 210 and a pull tab connecting part 230 on the upper surface 11*a* of the slider body 10. Since the slider body 10 of the slider 201 is substantially the same as that of the slider 1, the same reference numerals are used and descriptions thereof are omitted. The pull tab connecting part 230 comprises a cantilevered pull tab connecting post 231, in which one end portion (proximal portion) 231*a* is fixed to the rear end, in the longitudinal direction, on the upper surface 11*a* of the upper blade 11; and the other end portion 231*b* separated from the upper surface 11*a*; and a closing member 240, which is made of a synthetic resin and can be detachably attached to the front side in the longitudinal direction between the other end portion 231*b* of the pull tab connecting post 231 and the upper surface 11*a*. In this embodiment, a keyhole portion 250 that defines a keyhole 250*a* is incorporated in the closing member 240. The closing member 240 comprising an outside portion 241 defining an outside surface 240*a* facing frontward in the longitudinal direction, and an engaging portion 242 provided on the rear back of the outside portion 241. Further, on the front side, in the longitudinal direction, of the upper surface 11*a* of the upper blade 11, a fixing portion (not shown) is provided, and the fixing portion is substantially the same as the above-described fixing portion 20 except for its longitudinal direction and position. The engagement structure of the engaging portion 242 and the fixing portion 20 can be substantially the same as that described for the slider 1 or 101 except that the front and rear in the longitudinal direction are reversed. Also in this embodiment, since the engaging portion of the closing member 240 is provided on the rear back of the outside portion 241 of the closing member 240, and the fixing portion is hidden behind the rear back of the outside portion 241 of the closing member 240 in the attached state, the fixing structure of the closing member 240 is hard to be seen from the outside. Further, by mounting two sliders 201 to a common fastener chain in opposite directions to each other, the respective keyholes 150*a* can overlap in the width direction in the abutted state.

DESCRIPTION OF REFERENCE NUMERALS

1, 101, 201 slider
10 slider body
11 upper blade
12 lower blades
13 guide post
14 shoulder opening
15 rear opening
20,120 fixing portion
21,121 locking portion
22,122 positioner
30, 130, 230 pull tab connecting part
31, 131, 231 Pull tab connecting post
31*a* one end portion (proximal portion) of the pull tab connecting post
31*b* the other end portion (free end portion) of pull tab connecting post
31*aa* edge on the other end portion-side in the one end portion of the pull tab connecting post
31*ba* edge on the one end portion-side in the other end portion of the pull tab connecting post
40, 140, 240 closing member
40*a*, 140*a*, 240*a* outside surface
41, 141, 241 outside portion (cover portion)
42, 142, 242 engaging portion
43 lock leg (leg, flexible portion)
43*a*, 148 lock claw

44, 149 positioner receiving portion
144 leg
145 leaf spring (flexible portion)

The invention claimed is:

1. A slider (1, 101, 201) for a slide fastener, comprising:

a slider body (10) including an upper blade (11), a lower blade (12), and a guide post (13) connecting between one end sides, in a longitudinal direction, of the upper and lower blades (11, 12), and a pull tab connecting part (30, 130, 230) provided on an upper surface (11*a*) of the upper blade (11) of the slider body (10) for connecting a pull tab (60);

wherein the pull tab connecting part (30, 130, 230) comprises a cantilevered pull tab connecting post (31, 231), in which one end portion (31*a*, 231*a*) is fixed to the upper surface (11*a*) of the upper blade (11) at one end side or the other end side in the longitudinal direction and the other end portion (31*b*, 231*b*) is separated from the upper surface (11*a*) at the other end side or the one end side in the longitudinal direction; and a closing member (40, 140, 240) attached to between the other end portion (31*b*, 231*b*) of the pull tab connecting post (31, 231) and the upper surface (11*a*) of the upper blade (11);

wherein the slider body (10) includes a fixing portion (20, 120) provided on the upper surface (11*a*) of the upper blade (11) for fixing the closing member (40, 140, 240);

wherein, the closing member (40, 140, 240) includes an outside portion (41, 141, 241) defining an outside surface (40*a*, 140*a*, 240*a*) facing a side of the closing member opposite to the one end portion (31*a*, 231*a*) of the pull tab connecting post (31, 231) in the longitudinal direction, in a state where the closing member (40, 140, 240) is attached to the upper surface (11*a*) of the upper blade (11), and an engaging portion (42, 142, 242), which is provided on a one end portion (31*a*, 231*a*)-side of the outside portion (41, 141, 241) and is engageable with the fixing portion (20, 120), and wherein the engaging portion (42, 142, 242) of the closing member (40) is provided on an inside back of the outside portion (41, 141, 241), and the fixing portion (20, 120) is provided on the inside back of the outside portion (41, 141, 241), in a state where the closing member (40, 140, 240) is attached to the upper surface (11*a*) of the upper blade (11), so that the outside portion (41, 141, 241) is located exterior to the engaging portion and surrounds the fixing portion (20, 120).

2. The slider according to claim 1, wherein at least a portion of the fixing portion (20, 120) is arranged, in the longitudinal direction, between an edge (31*ba*) of the one end portion (31*a*)-side in the other end portion (31*b*) of the pull tab connecting post (31) and an edge (31*aa*) of the other end portion (31*b*)-side in the one end portion (31*a*) of the pull tab connecting post (31).

3. The slider according to claim 1, wherein one of the engaging portion (42, 142, 242) and the fixing portion (20, 120) includes one or more flexible portions (43, 145) having one or more lock claws (43*a*, 148), and the other of the engaging portion (42, 142, 242) and the fixing portion (20, 120) includes one or more locking portions (21, 121) which are configured to receive and lock the lock claws (43*a*, 148).

4. The slider according to claim 3, wherein at least one of the engaging portion (42, 142, 242) and the fixing portion (20, 120) includes a positioner (22, 44, 122, 149) for restraining the closing member (40, 140, 240) in a position where the lock claws (43*a*, 148) are locked by the locking portions (21, 121).

5. The slider according to claim 3, wherein the engaging portion (42, 142, 242) comprises a pair of legs (43, 144) in a width direction of the slider body (10), and the lock claws (43*a*, 148) and the locking portions (21, 121) are arranged between the pair of the legs (43, 144).

6. The slider according to claim 3, wherein the flexible portions (145) are a leaf spring (145) provided in the engaging portion (142) of the closing member (140), the leaf spring (145) being flexible in a vertical direction.

7. The slider according to claim 1, wherein the closing member (40, 140, 240) in a state of being attached to the upper surface (11*a*) of the upper blade (11) is non-fixedly aligned with the other end portion (31*b*, 231*b*) of the pull tab connecting post (31, 231).

8. The slider according to claim 1, wherein the fixing portion (20, 120) is located higher than the upper surface (11*a*) of the upper blade (11).

9. The slider according to claim 1, wherein the closing member (40, 140, 240) is made of synthetic resin.

10. The slider according to claim 1, wherein the outside portion covers the engagement between the engaging portion and the fixing portion.

* * * * *